US011464377B2

(12) United States Patent
Hong et al.

(10) Patent No.: US 11,464,377 B2
(45) Date of Patent: Oct. 11, 2022

(54) VACUUM CLEANER

(71) Applicant: Samsung Electronics Co., Ltd., Suwon-si (KR)

(72) Inventors: Seokman Hong, Suwon-si (KR); Kihwan Kwon, Suwon-si (KR); Dongwoo Ha, Suwon-si (KR); Taegwang Kim, Suwon-si (KR); Jiwon Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 333 days.

(21) Appl. No.: 16/839,681

(22) Filed: Apr. 3, 2020

(65) Prior Publication Data

US 2020/0315416 A1 Oct. 8, 2020

(30) Foreign Application Priority Data

Apr. 4, 2019 (KR) ..... 10-2019-0039358

(51) Int. Cl.
*A47L 9/04* (2006.01)
*A46B 17/06* (2006.01)

(52) U.S. Cl.
CPC ..... *A47L 9/0488* (2013.01); *A46B 17/06* (2013.01); *A47L 9/0477* (2013.01); *A46B 2200/30* (2013.01)

(58) Field of Classification Search
CPC ..... A47L 9/0488; A47L 9/0477; A47L 5/30; A47L 9/0411; A47L 9/0633; A47L 9/0461; A46B 17/06; A46B 2200/30; A46B 13/001; B08B 1/007
See application file for complete search history.

(56) References Cited

U.S. PATENT DOCUMENTS 10,045,672 B2 8/2018 Eriksson

FOREIGN PATENT DOCUMENTS

| | | | |
|---|---|---|---|
| EP | 2253258 | A2 | 11/2010 |
| EP | 3342323 | A2 | 7/2018 |
| KR | 10-2008-0086690 | A | 9/2008 |
| WO | 2018/218157 | A1 | 11/2018 |

OTHER PUBLICATIONS

European Search Report dated Oct. 2, 2020 in connection with European Patent Application No. 20 16 7195, 5 pages.

*Primary Examiner* — David Redding

(57) ABSTRACT

A suction head of a vacuum cleaner including a housing having a suction port, a drum brush rotatably installed in the housing, a foreign substance removal pad provided on an inner surface of the housing to remove foreign substances wound on the drum brush by friction, and an anti-slip pad provided on the drum brush to prevent the foreign substances from slipping upon experiencing the friction with the foreign substance removal pad.

15 Claims, 16 Drawing Sheets

VACUUM CLEANER

CROSS-REFERENCE TO RELATED APPLICATION

This application is based on and claims priority under 35 U.S.C. § 119 to Korean Patent Application No. 10-2019-0039358, filed on Apr. 4, 2019, in the Korean Intellectual Property Office, the disclosure of which is incorporated by reference herein in its entirety.

BACKGROUND

1. Field

The disclosure relates to a vacuum cleaner having a suction head provided with a rotating drum brush, and more particularly, to a vacuum cleaner having a structure for removing foreign substances wound on the drum brush.

2. Description of Related Art

Generally, a vacuum cleaner is a home appliance which performs cleaning by including a suction force generator for generating a suction force, a suction head for sucking air and foreign substances on a surface to be cleaned through the suction force of the suction force generator, and a foreign substance collection chamber for separating and collecting foreign substances from the air sucked through the suction head.

The suction head may include a housing having a suction port and a drum brush for sweeping a surface to be cleaned to induce foreign substances on the surface to be cleaned to be efficiently sucked into the suction port. The drum brush may be rotatably connected to a driver.

The drum brush is composed of a cylindrical drum body, a plurality of brush bristles provided on an outer circumferential surface of the drum body, and as the drum brush rotates, hair, animal fur, and thread among the foreign substances sucked through the suction port may be caught between and wound on the plurality of brush bristles.

SUMMARY

It is an aspect of the disclosure to provide a suction head having a structure capable of removing foreign substances from a drum brush by crushing or breaking the foreign substances such as hair, animal fur, and thread wound on the drum brush, and a vacuum cleaner including the suction head.

It is an aspect of the disclosure to provide a vacuum cleaner having a structure capable of easily mounting a plurality of brush bristles and a blade, which prevents foreign substances from being caught between and wound on the plurality of brush bristles, on a drum body.

Additional aspects of the disclosure will be set forth in part in the description which follows and, in part, will be obvious from the description, or may be learned by practice of the disclosure.

In accordance with an aspect of the disclosure, a vacuum cleaner includes a cleaner body including a suction force generator configured to generate a suction force and a foreign substance collection chamber configured to collect foreign substances, and a suction head connected to the cleaner body to suck foreign substances on a surface to be cleaned and guide the foreign substances to the foreign substance collection chamber, wherein the suction head includes a housing having a suction port, a drum brush rotatably installed in the housing such that the foreign substances are sucked into the housing through the suction port, and including a cylindrical drum body and a brush provided on an outer circumferential surface of the drum body, a foreign substance removal pad provided on an inner surface of the housing to remove the foreign substances on the drum brush by friction with the foreign substances wound on the drum brush, and an anti-slip pad provided on the outer circumferential surface of the drum body to prevent the foreign substances from slipping on the drum body.

The foreign substance removal pad may be formed of a material having a higher friction coefficient than the housing.

The foreign substance removal pad may include sand paper having friction particulates.

The foreign substance removal pad may include a friction surface formed with irregularities to increase a friction force.

The housing may include a lower housing and an upper housing, the suction port may be formed in the lower housing, and the foreign substance removal pad may be provided in the upper housing.

The foreign substance removal pad may be provided at a central portion in a longitudinal direction of the housing.

The foreign substance removal pad and the brush may be spaced apart from each other.

The anti-slip pad may be of a material having a higher friction coefficient than the drum body.

The anti-slip pad may be formed of a rubber material.

The anti-slip pad may include a friction surface formed with irregularities to increase a friction force.

The anti-slip pad may include an inclined surface formed to be inclined with respect to the outer circumferential surface of the drum body at opposite ends in the longitudinal direction of the anti-slip pad to allow the foreign substances to be transferred upward on the anti-slip pad.

The brush may include a brush band extending between opposite ends in an axial direction of the drum body, and a plurality of brush bristles protruding from the brush band to be spaced apart from each other by a predetermined interval along the brush band.

The drum brush may include a blade provided in the vicinity of the brush to extend along the brush band such that the foreign substances are prevented from being caught between the plurality of brush bristles.

The drum body may include a coupling groove formed on the outer circumferential surface of the drum body to extend between the opposite ends in the axial direction of the drum body, and the blade may include a blade base inserted into and coupled to the coupling groove.

The blade base may include an installation groove extending between opposite ends in a longitudinal direction of the blade base to allow the brush band to be inserted and coupled thereto.

In accordance with another aspect of the disclosure, a vacuum cleaner includes a cleaner body comprising a suction force generator configured to generate a suction force and a foreign substance collection chamber configured to collect foreign substances, and a suction head connected to the cleaner body to suck foreign substances on a surface to be cleaned and guide the foreign substances to the foreign substance collection chamber and in which a drum brush is rotatably installed to induce suction of the foreign substances, wherein the drum brush includes a cylindrical drum body, a brush comprising a brush band extending between opposite ends in an axial direction of the drum body and a plurality of brush bristles protruding from the brush band to be spaced apart from each other by a predetermined interval along the brush band, and a blade provided in the vicinity of the brush to extend along the brush band such that the foreign substances are prevented from being caught between the plurality of brush bristles.

The drum body may include a coupling groove formed on the outer circumferential surface of the drum body to extend between the opposite ends in the axial direction of the drum body, and the blade may include a blade base inserted into and coupled to the coupling groove.

The blade base may include an installation groove extending between opposite ends in a longitudinal direction of the blade base to allow the brush band to be inserted and coupled thereto.

The blade may include a blade body extending in a radial direction of the drum body in the blade base such that the foreign substances are prevented from being caught between the plurality of brush bristles, and the blade body may be provided with through holes.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
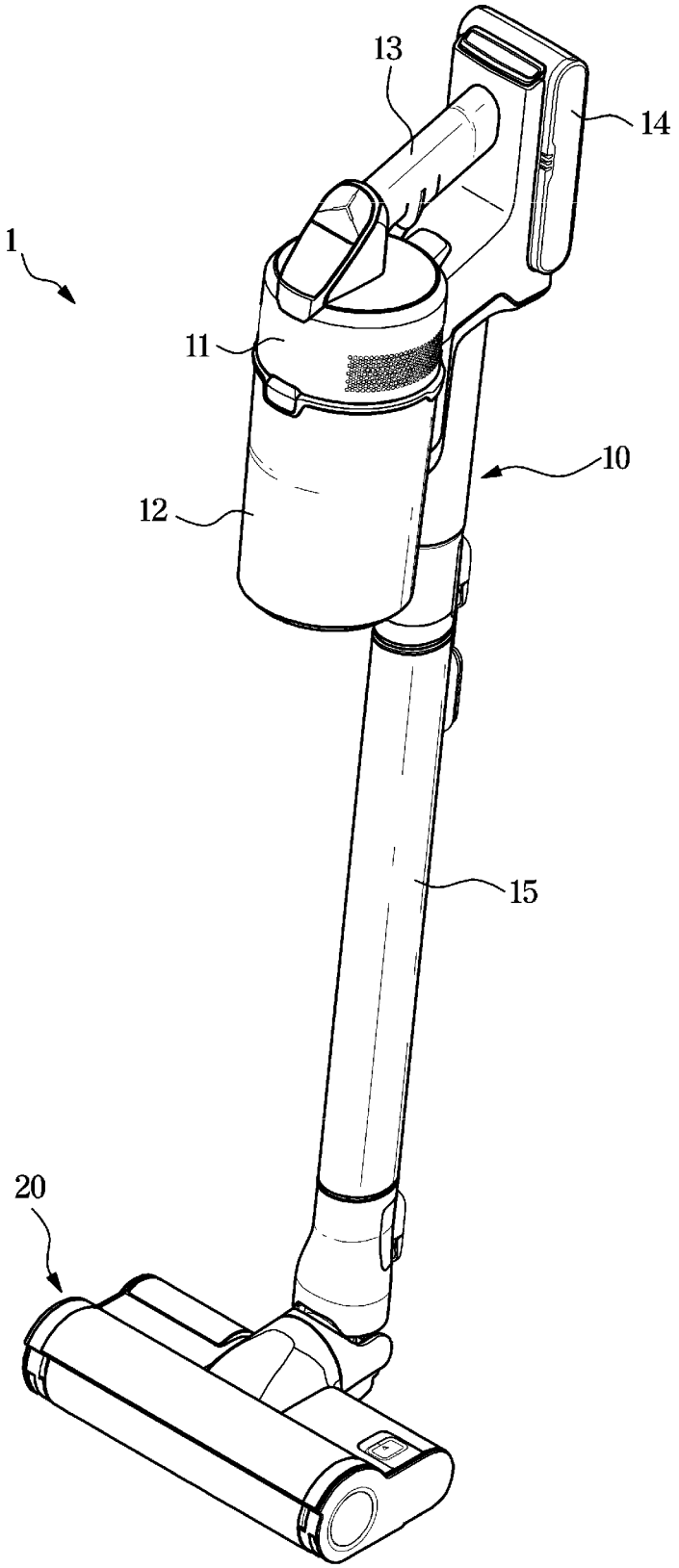
FIG. 1 illustrates a vacuum cleaner according to an embodiment of the disclosure.

FIGS. 1 through 16, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Configurations shown in the embodiments and the drawings described in the present specification are only the preferred embodiments of the present disclosure, and thus it is to be understood that various modified examples, which may replace the embodiments and the drawings described in the present specification, are possible when filing the present application.

It is to be understood that the singular forms "a," "an," and "the" include plural referents unless the context clearly dictates otherwise. Shape and size of the elements in the drawings may be exaggerated for clarity.

It will be understood that when the terms "includes," "comprises," "including," and/or "comprising," when used in this specification, specify the presence of stated features, figures, steps, components, or combination thereof, but do not preclude the presence or addition of one or more other features, figures, steps, components, members, or combinations thereof.

Hereinafter, preferred embodiments of the disclosure will be described in detail with reference to the accompanying drawings.

FIG. 1 illustrates a vacuum cleaner according to an embodiment of the disclosure.

Referring to FIG. 1, a vacuum cleaner 1 may include a cleaner body 10, a suction head 20, and an extension pipe 15 configured to connect the cleaner body 10 and the suction head 20.

The cleaner body 10 may include a suction force generator 11 configured to generate suction force, a foreign substance collection chamber 12 configured to separate and collect foreign substances from the sucked air, a handle 13, and a battery 14 configured to supply power to the suction force generator 11.

The suction force generator 11 may include a motor configured to convert an electric force into a rotational force, and a fan rotatably connected to the motor. The foreign substance collection chamber 12 may collect foreign substances through a cyclone method of separating foreign substances using a centrifugal force or through a dust bag method of separating foreign substances by passing air through a filter bag. The air from which foreign substances are removed through the foreign substance collection chamber 12 may be discharged to the outside of the cleaner body 10.

The extension pipe 15 may be formed of a pipe having a predetermined rigidity or a flexible hose. The extension pipe 15 may transmit the suction force generated through the suction force generator 11 to the suction head 20 and may guide air and foreign substances sucked through the suction head 20 to the cleaner body 10.

The suction head 20 may be in close contact with a surface to be cleaned to suck air and foreign substances on the surface to be cleaned. The suction head 20 may be rotatably coupled to the extension pipe 15.

Figure 2:
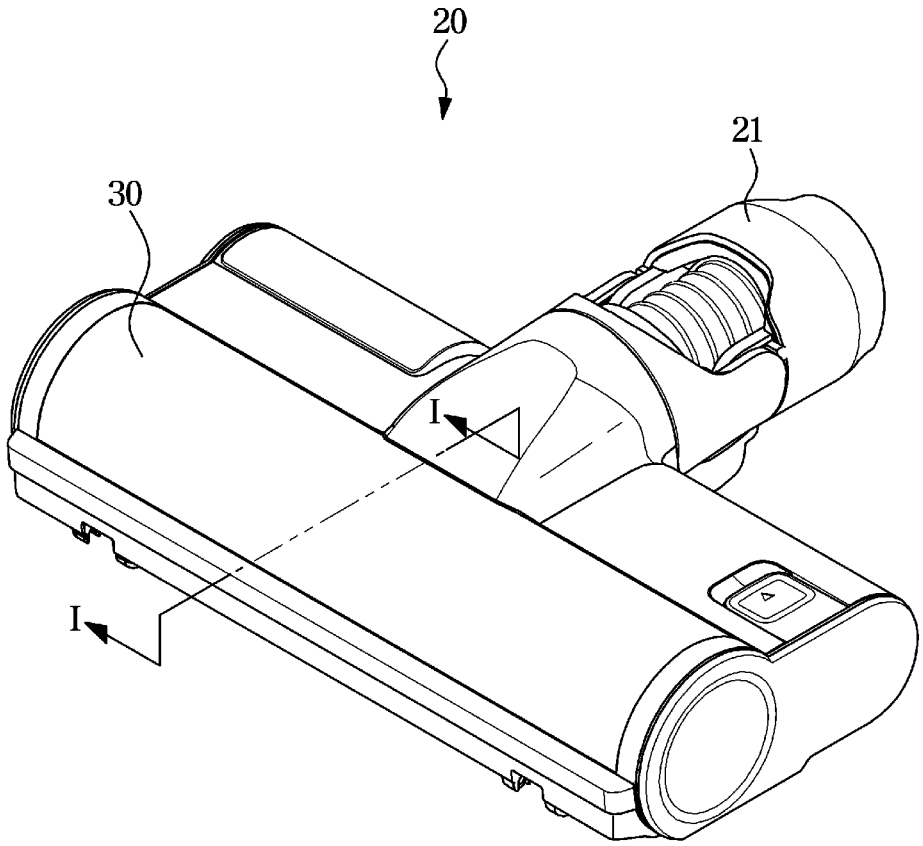
FIG. 2 illustrates a perspective view of a suction head of the vacuum cleaner according to an embodiment of the disclosure.
Figure 3:
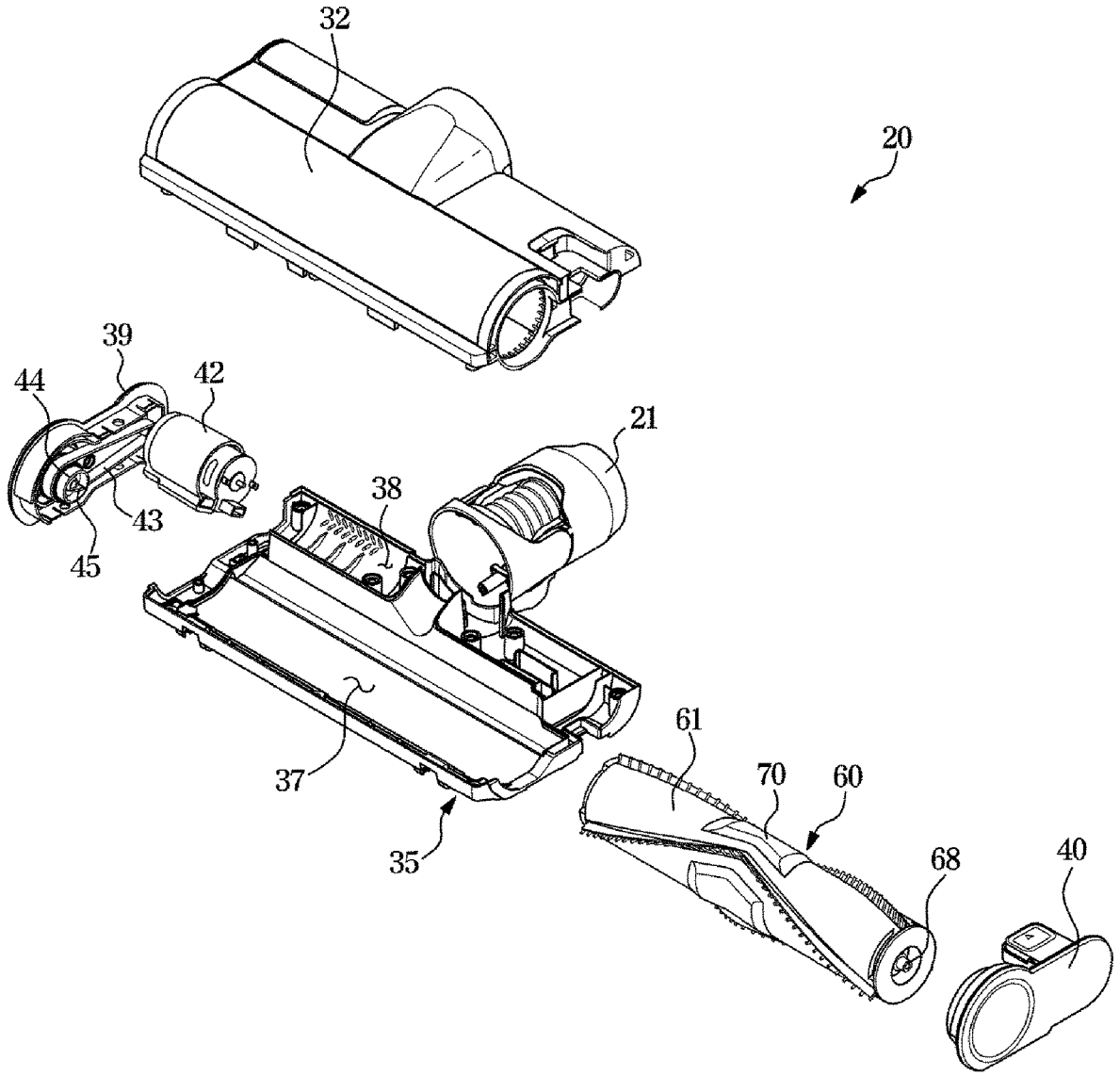
FIG. 3 illustrates an exploded perspective view of the suction head of the vacuum cleaner according to an embodiment of the disclosure.
Figure 4:
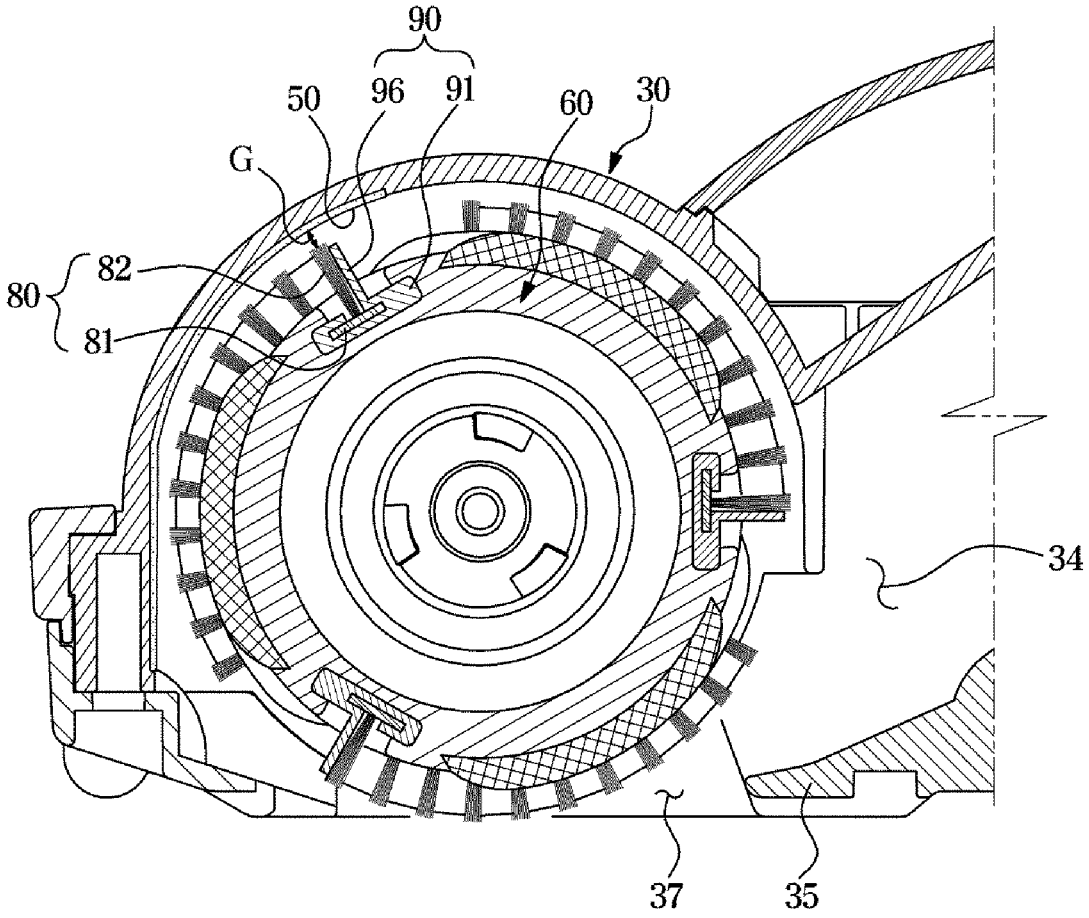
FIG. 4 is a cross-sectional view taken along line I-I of FIG. 2, illustrating the suction head of the vacuum cleaner according to an embodiment of the disclosure.
Figure 5:
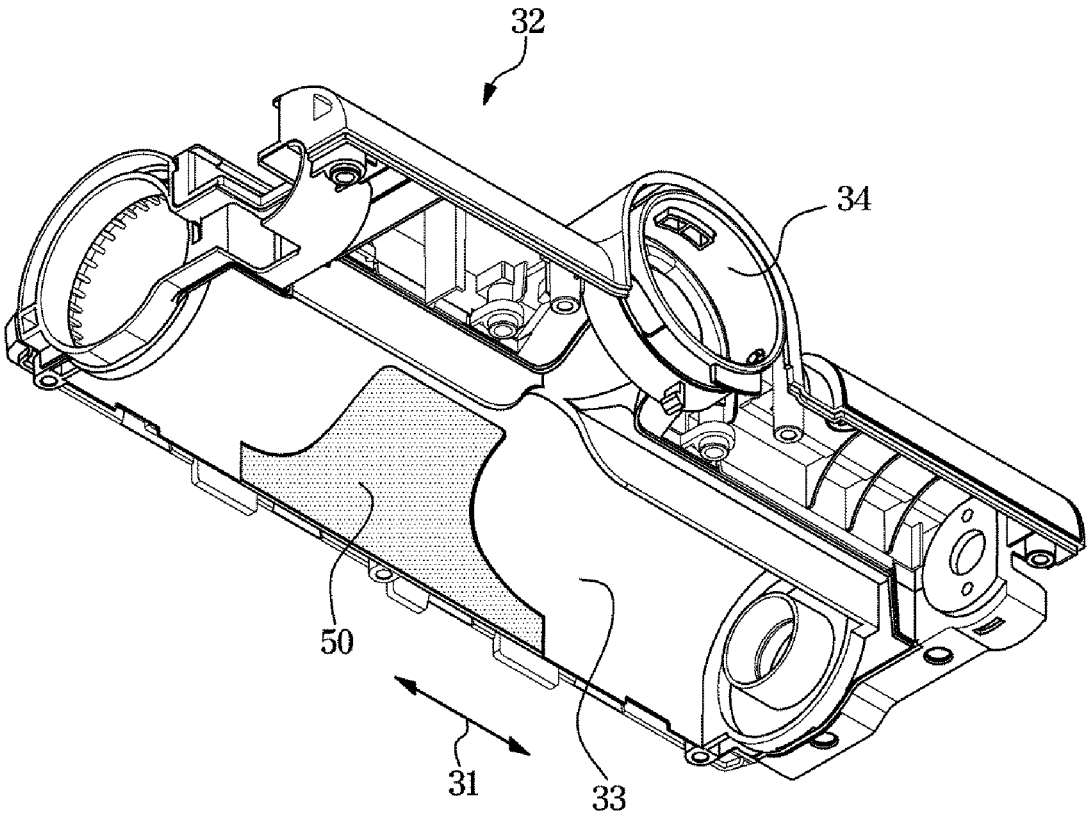
FIG. 5 illustrates a foreign substance removal pad of the vacuum cleaner according to an embodiment of the disclosure.
Figure 6:
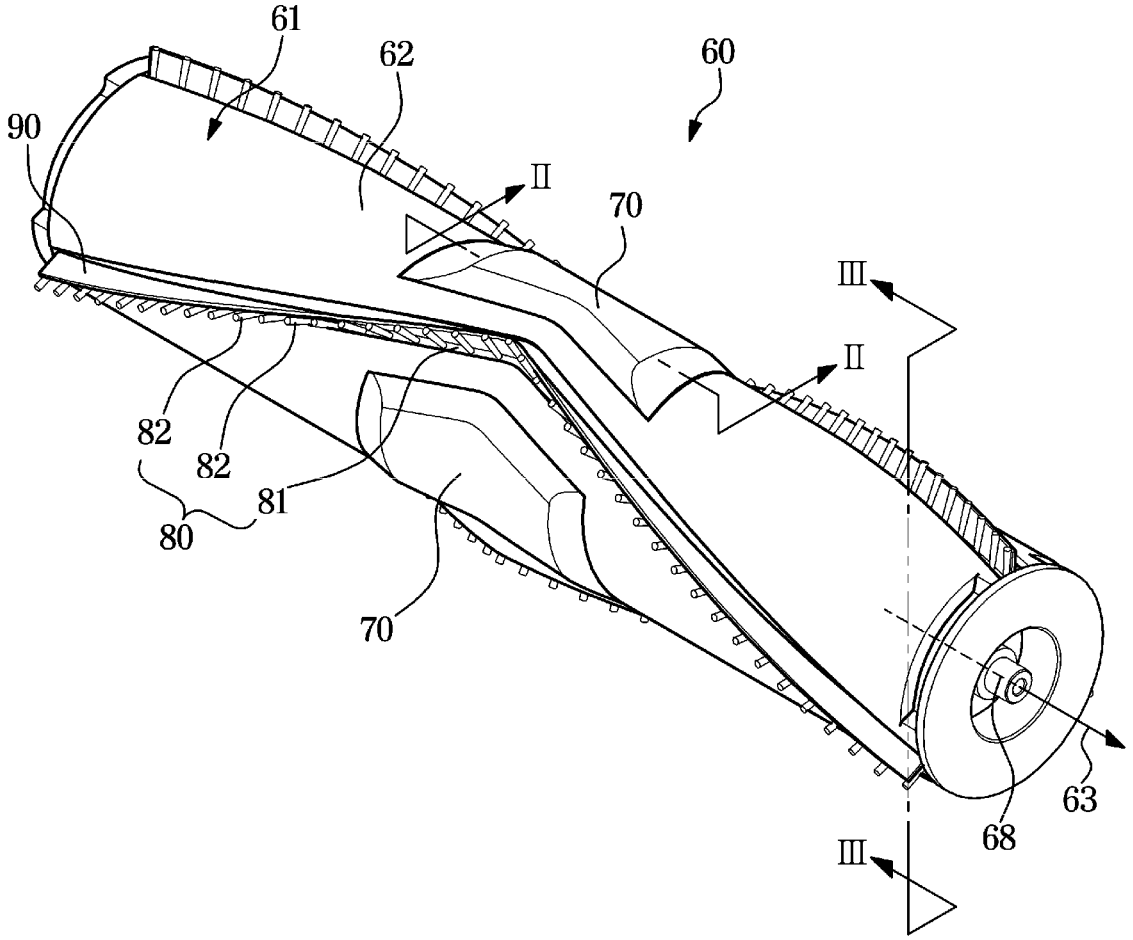
FIG. 6 illustrates a drum brush of the vacuum cleaner according to an embodiment of the disclosure.
Figure 7:
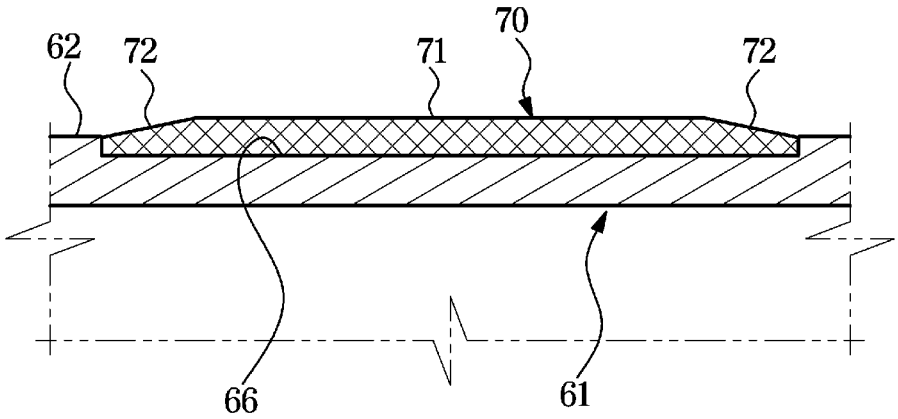
FIG. 7 is a cross-sectional view taken along line II-II of FIG. 6, illustrating an anti-slip pad of the vacuum cleaner according to an embodiment of the disclosure.
Figure 8:
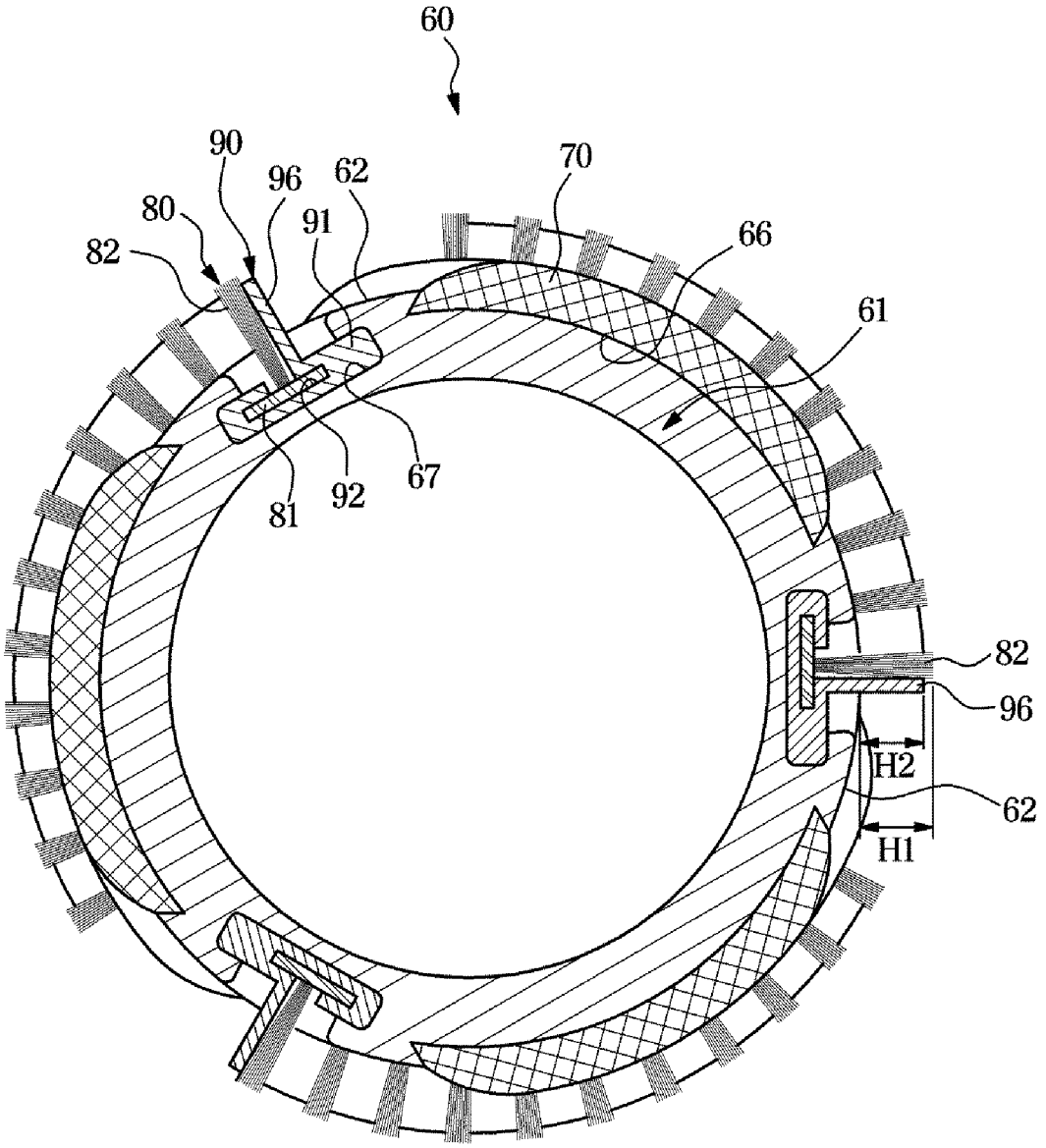
FIG. 8 is a cross-sectional view taken along line III-III of FIG. 6, illustrating the drum brush of the vacuum cleaner according to an embodiment of the disclosure.
Figure 9:
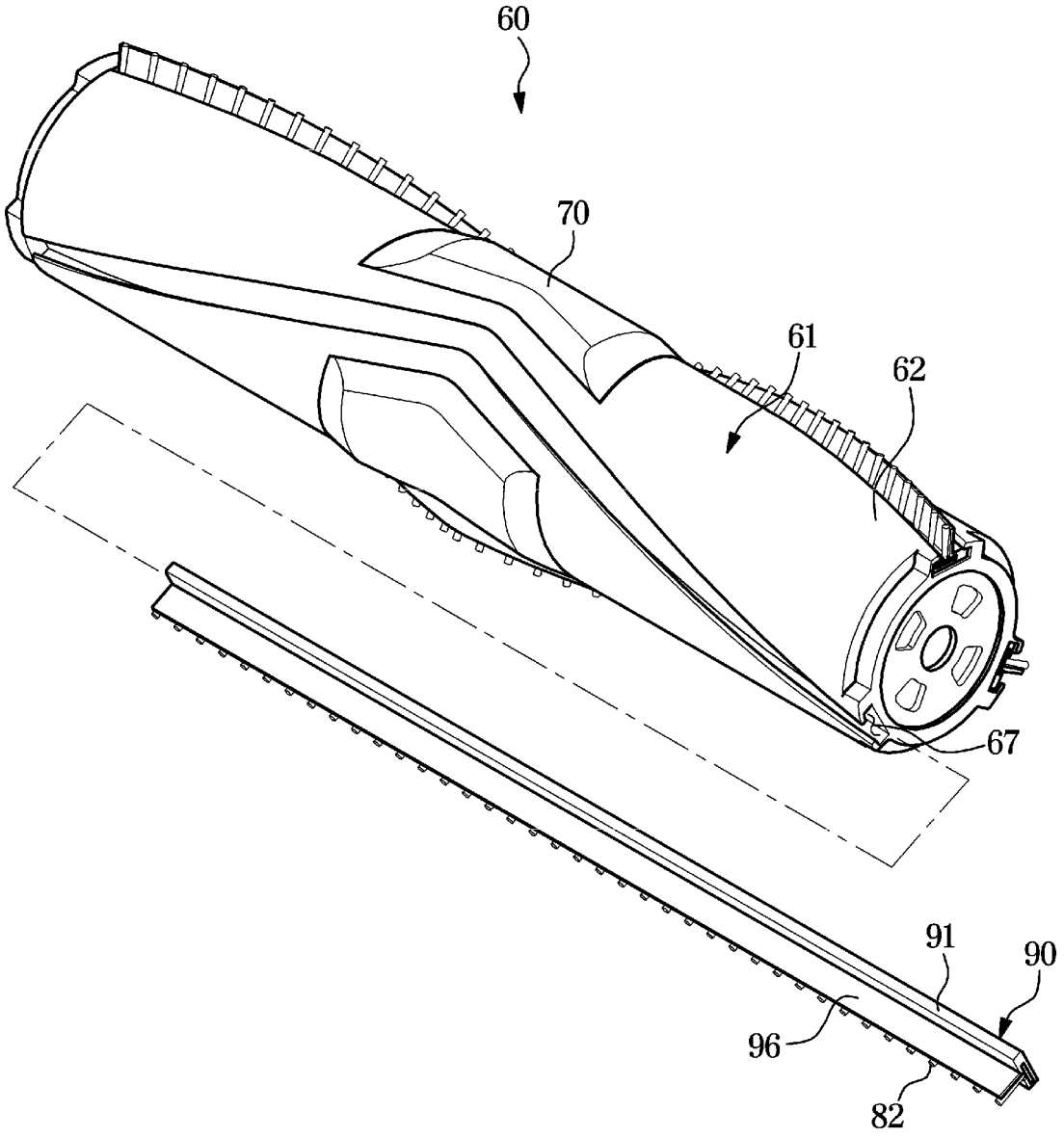
FIG. 9 illustrates a blade and a brush separated from a drum body of the vacuum cleaner according to an embodiment of the disclosure.
Figure 10:
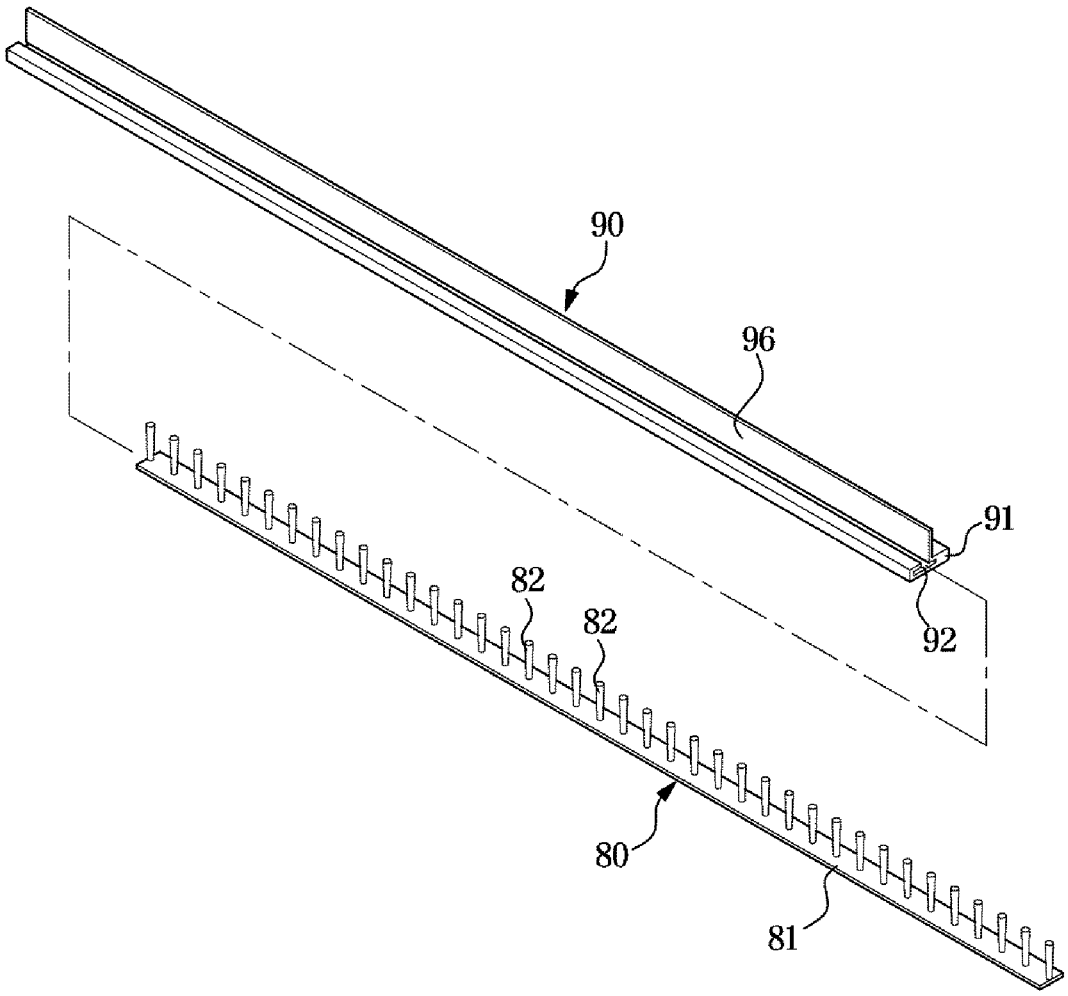
FIG. 10 illustrates a structure for coupling the blade and the brush of the vacuum cleaner according to an embodiment of the disclosure.

FIG. 2 illustrates a perspective view of a suction head of the vacuum cleaner according to an embodiment of the disclosure. FIG. 3 illustrates an exploded perspective view of the suction head of the vacuum cleaner according to an embodiment of the disclosure. FIG. 4 is a cross-sectional view taken along line I-I of FIG. 2, illustrating the suction head of the vacuum cleaner according to an embodiment of the disclosure. FIG. 5 illustrates a foreign substance removal pad of the vacuum cleaner according to an embodiment of the disclosure. FIG. 6 illustrates a drum brush of the vacuum cleaner according to an embodiment of the disclosure. FIG. 7 is a cross-sectional view taken along line II-II of FIG. 6, illustrating an anti-slip pad of the vacuum cleaner according to an embodiment of the disclosure. FIG. 8 is a cross-sectional view taken along line III-III of FIG. 6, illustrating the drum brush of the vacuum cleaner according to an embodiment of the disclosure. FIG. 9 illustrates a blade and a brush separated from a drum body of the vacuum cleaner according to an embodiment of the disclosure. FIG. 10 illustrates a structure for coupling the blade and the brush of the vacuum cleaner according to an embodiment of the disclosure.

Referring to FIGS. 2 to 10, the suction head 20 may include a housing 30 in which a suction port 37 is formed, a drum brush 60 configured to rotate such that foreign substances are effectively sucked into the housing 30 through the suction port 37, and a connector 21 configured to connect the housing 30 and the extension pipe 15.

The housing 30 may be formed by assembling an upper housing 32, a lower housing 35, a left side cover 39, and a right side cover 40.

The suction port 37 may be formed in the lower housing 35. Air and foreign substances sucked into the housing 30 through the suction port 37 may be discharged to the outside of the housing 30 through the connector 21. The suction port 37 may be formed in the lower housing 35 to extend along a longitudinal direction 31 of the housing 30. The connector 21 may be formed at a central portion of the housing 30 in the longitudinal direction 31.

The upper housing 32 may be provided with a connection opening 34 to which the connector 21 is connected. A foreign substance removal pad 50, which will be described later, may be provided on an inner circumferential surface 33 (FIG. 5) of the upper housing 32.

The drum brush 60 may be rotatably provided in the housing 30. The suction head 20 may include a driver providing a rotational force to rotate the drum brush 60. The driver may include a motor 42 generating a rotational force, a pulley 44 having a coupler 45 to which the drum brush 60 is coupled, and a belt 43 transmitting the rotational force of the motor 42 to the pulley 44. The housing 30 may include a motor chamber 38 in which the motor 42 is accommodated.

The drum brush 60 may include a cylindrical drum body 61, and a brush 80 provided on an outer circumferential surface 62 of the drum body 61 to scatter foreign substances by sweeping the surface to be cleaned. A rotating pin 68 may be provided at opposite ends of the drum body 61. The rotating pin 68 can be coupled to the coupler 45.

The brush 80 may include a brush band 81 extending between opposite ends in an axial direction 63 (FIG. 6) of the drum body 61, and a plurality of brush bristles 82 protruding from the brush band 81. The plurality of brush bristles 82 may be formed to be spaced apart from each other along the brush band 81.

The brush 80 may be provided in a substantially 'V' shape so as to transfer foreign substances to a central portion of the drum brush 60 when the drum brush 60 rotates.

As such, because the plurality of brush bristles 82 is formed to be spaced apart from each other by a predetermined interval, foreign substances such as hair, animal hair, and thread may be caught between the plurality of brush bristles 82. When the foreign substances are caught between the plurality of brush bristles 82, the foreign substances may be wound on the drum brush 60 when the drum brush 60 rotates. The foreign substances wound on the drum brush 60 may be stuck to the drum brush 60 despite the suction force of the cleaner body 10. Therefore, the cleaning efficiency of the vacuum cleaner 1 may be lowered, and furthermore, the rotation of the drum brush 60 may be restrained.

In order to prevent the phenomenon of foreign substances being wound on the drum brush 60 in this way, the drum brush 60 may include a blade 90 provided in the vicinity of the brush 80 to extend along the brush band 81.

Because the blade 90 is provided in the vicinity of the brush 80 to block between the brush bristles 82, the phenomenon of foreign substances being caught between the brush bristles 82 may be prevented or reduced. The blade 90 may be formed of a material having elasticity and flexibility such as rubber.

The blade 90 may include a blade base 91 inserted into and coupled to a coupling groove 67 formed on the outer circumferential surface 62 of the drum body 61, and a blade body 96 extending in a radial direction of the drum body 61 from the blade base 91. The coupling groove 67 may be formed on the outer circumferential surface 62 of the drum body 61 to extend between the opposite ends in the axial direction of the drum body 61.

As illustrated in FIG. 8, in order not to interfere with brush bristle 82 sweeping the surface to be cleaned, a height H2 of the blade body 96 from the outer circumferential surface 62 of the drum body 61 may be less than a height H1 of the brush bristle 82. Through this configuration, the blade body 96 may not be in contact with the surface to be cleaned.

The blade base 91 may include an installation groove 92 formed to allow the brush band 81 of the brush 80 to be inserted and coupled thereto. The installation groove 92 may be formed to extend between opposite ends in a longitudinal direction of the blade base 91.

Through this configuration, as illustrated in FIG. 10, the blade 90 and the brush 80 may be easily assembled by inserting the brush band 81 of the brush 80 into the installation groove 92 of the blade 90.

Next, as illustrated in FIG. 9, the blade 90 and the brush 80 may be easily mounted on the drum body 61 by inserting the blade base 91 of the blade 90 into the coupling groove 67 formed on the outer circumferential surface 62 of the drum body 61.

As described above, due to the configuration of the blade 90, foreign substances may be prevented or reduced from being caught between the plurality of brush bristles 82. However, foreign substances such as hair, animal fur, and thread may still be wound on the drum brush 60, and thus the suction head 20 according to an embodiment of the disclosure may include the foreign substance removal pad 50 to remove foreign substances wound on the drum brush 60 from the drum brush 60.

As illustrated in FIGS. 4 and 5, the foreign substance removal pad 50 may be provided on an inner surface 33 of the housing 30. The foreign substance removal pad 50 may unwound the foreign substances by crushing or breaking the foreign substances by friction with the foreign substances wound on the drum brush 60.

To this end, the foreign substance removal pad 50 may be formed of a rough material having a high friction coefficient. The foreign substance removal pad 50 may be formed of a material having a higher friction coefficient than the housing 30. As an example, the foreign substance removal pad 50 may include sand paper having friction particulates. The foreign substance removal pad 50 may be attached to the inner surface 33 of the housing 30 via an adhesive or other fastening member.

The foreign substance removal pad 50 may be provided at the central portion in the longitudinal direction 31 of the housing 30.

Because the extension pipe 15 is connected to a central portion of the suction head 20, foreign substances sucked into the housing 30 through the suction port 37 may be transferred to the central portion of the housing 30 by a suction force. In addition, due to the 'V' shape of the brush 80 as described above, the foreign substances may be transferred to the central portion of the housing 30.

Therefore, it is sufficient that the foreign substance removal pad 50 is provided at the central portion in the longitudinal direction 31 of the housing 30. However, unlike the present embodiment, the foreign substance removal pad 50 may be provided on the entire inner surface of the housing 30.

As illustrated in FIG. 4, when the drum brush 60 rotates, a predetermined gap G is provided between the foreign substance removal pad 50 and the brush 80 so that the brush 80 provided on the outer circumferential surface 62 of the drum body 61 is not damaged by the foreign substance removal pad 50.

The drum brush 60 may include the anti-slip pad 70 provided on the outer circumferential surface 62 of the drum body 61 to prevent foreign substances from slipping on the drum brush 60 upon friction with the foreign substance removal pad 50.

Because the frictional force between the foreign substance removal pad 50 and the foreign substances may be reduced when foreign substances slip on the drum brush 60 upon friction with the foreign substance removal pad 50, the foreign substances may be more effectively removed by the configuration of the anti-slip pad 70 preventing the foreign substances from slipping.

To this end, the anti-slip pad 70 may be formed of a material having a high friction coefficient. The anti-slip pad 70 may be formed of a material having a higher friction coefficient than the drum body 61. For example, the anti-slip pad 70 may be formed of a rubber material. The anti-slip pad 70 may be attached to a mounting groove 66 formed on the outer circumferential surface 62 of the drum body 61 via an adhesive or other fastening member.

Because the anti-slip pad 70 is configured to prevent foreign substances from slipping upon friction with the foreign substance removal pad 50, the anti-slip pad 70 may be provided at a position corresponding to the foreign substance removal pad 50. That is, the anti-slip pad 70 may be provided at the central portion in the axial direction of the drum body 61.

The anti-slip pad 70 may include an inclined surface 72 (FIG. 7) formed at opposite ends in the longitudinal direction of the anti-slip pad 70 in order not to interfere with foreign substances wound on the drum brush 60 from being transferred to the central portion of the drum brush 60 by a suction force. The inclined surface 72 may be inclined with respect to the outer circumferential surface 62 of the drum body 61. The foreign substances wound on the drum brush 60 may rise along the inclined surface 72 and may be smoothly transferred to a central portion 71 of the anti-slip pad 70.

Figure 11:
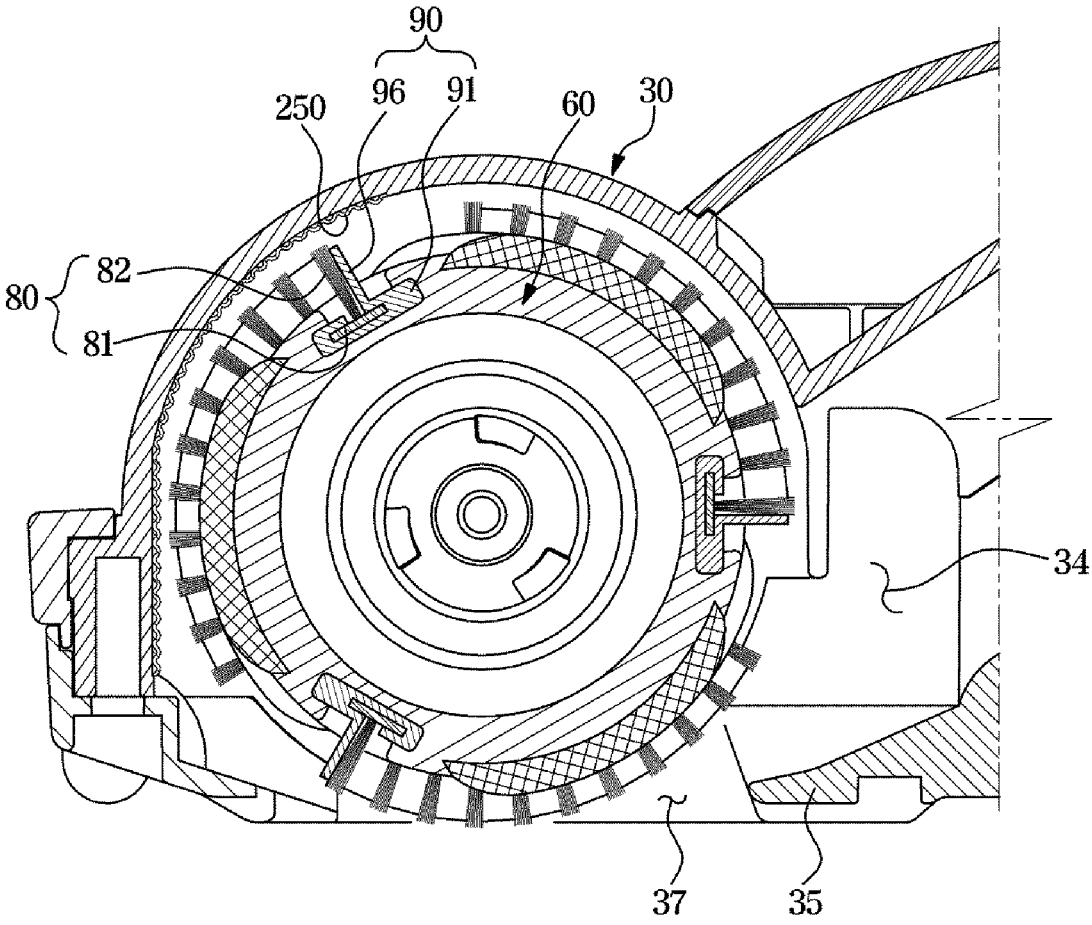
FIG. 11 illustrates a foreign substance removal pad of a vacuum cleaner according to another embodiment of the disclosure.

FIG. 11 illustrates a foreign substance removal pad of a vacuum cleaner according to another embodiment of the disclosure.

Hereinafter, a foreign substance removal pad of a vacuum cleaner according to another embodiment of the disclosure will be described with reference to FIG. 11. The same reference numbers are assigned to the same components as in the above-described embodiment, and descriptions thereof may be omitted.

Unlike the above-described embodiment, a foreign substance removal pad 250 may be integrally formed with the housing 30. That is, the foreign substance removal pad 250 may be formed of the same material as the housing 30.

The foreign substance removal pad 250 may include a friction surface having a predetermined shape capable of increasing a friction force. For example, the foreign substance removal pad 250 may include a friction surface having a shape of irregularity, embossing, bead, or the like. The foreign substance removal pad 250 may be post-processed after molding the housing 30 or molded together with the housing 30.

Figure 12:
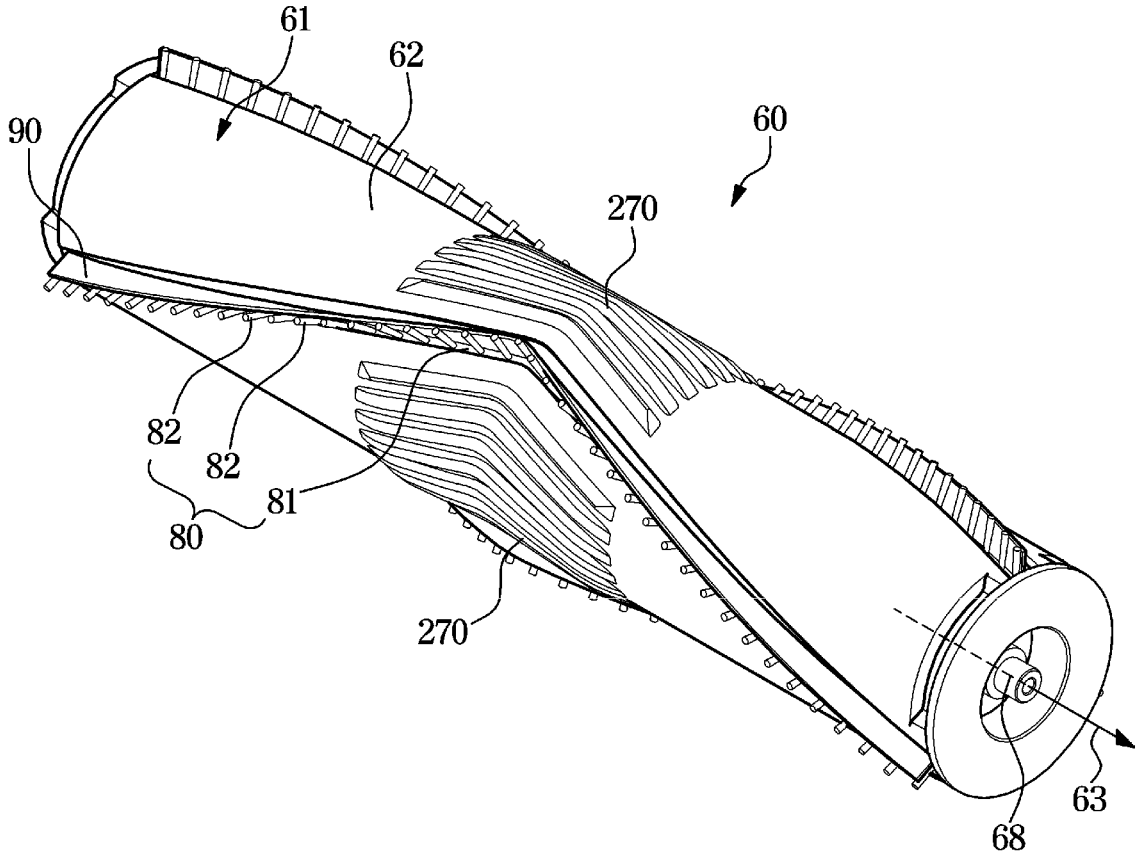
FIG. 12 illustrates an anti-slip pad of a vacuum cleaner according to another embodiment of the disclosure.

FIG. 12 illustrates an anti-slip pad of a vacuum cleaner according to another embodiment of the disclosure.

Hereinafter, an anti-slip pad of a vacuum cleaner according to another embodiment of the disclosure will be described with reference to FIG. 12. The same reference numbers are assigned to the same components as in the above-described embodiment, and descriptions thereof may be omitted.

Unlike the above-described embodiment, an anti-slip pad 270 may be integrally formed with the drum body 61. That is, the anti-slip pad 270 may be formed of the same material as the drum body 61.

The anti-slip pad 270 may include a friction surface having a predetermined shape capable of increasing a friction force. For example, the anti-slip pad 270 may include a friction surface having a shape of irregularity, embossing, bead, or the like. The anti-slip pad 270 may be post-processed after molding the drum body 61 or molded together with the drum body 61.

Figure 13:
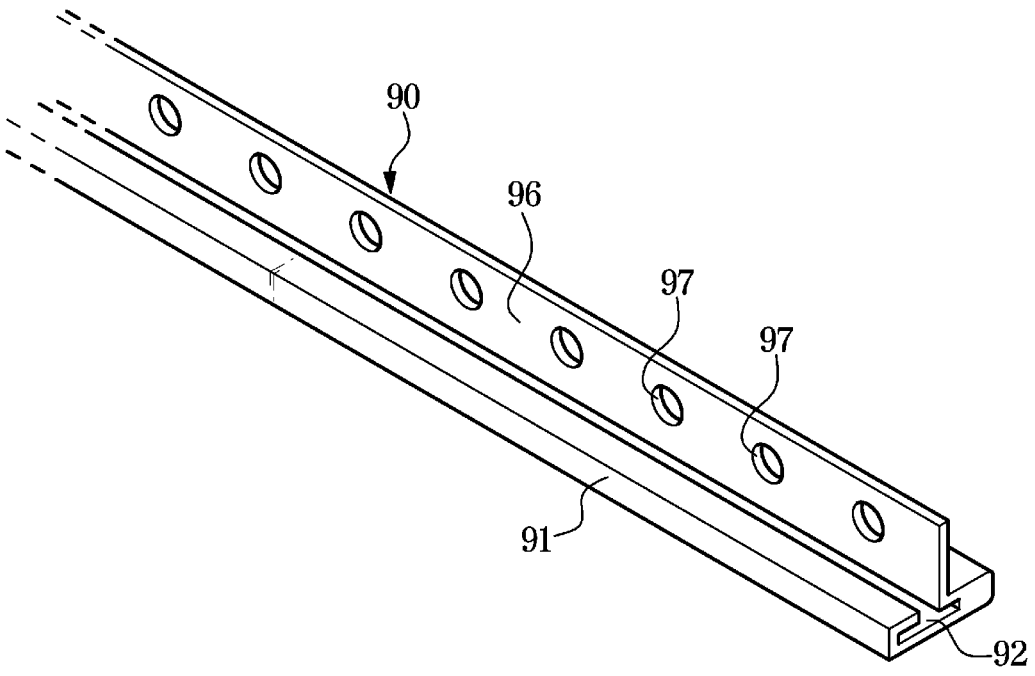
FIG. 13 illustrates a blade of a vacuum cleaner according to another embodiment of the disclosure.

FIG. 13 illustrates a blade of a vacuum cleaner according to another embodiment of the disclosure.

Hereinafter, a blade of a vacuum cleaner according to another embodiment of the disclosure will be described with reference to FIG. 13. The same reference numbers are assigned to the same components as in the above-described embodiment, and descriptions thereof may be omitted.

The blade 90 may include the blade base 91 inserted into and coupled to the coupling groove 67 formed on the outer circumferential surface 62 of the drum body 61, and the blade body 96 extending from the blade base 91 to prevent foreign substances from being caught between the plurality of brush bristles 82.

The blade body 96 may be provided with a plurality of through holes 97 formed to be spaced apart by a predetermined interval along a longitudinal direction of the blade 90. The through holes 97 may increase the flexibility of the blade body 96, and because foreign substances pass through the through holes 97, the phenomenon in which the foreign substances are wound on or entangled with the drum brush 60 may be reduced.

Figure 14:
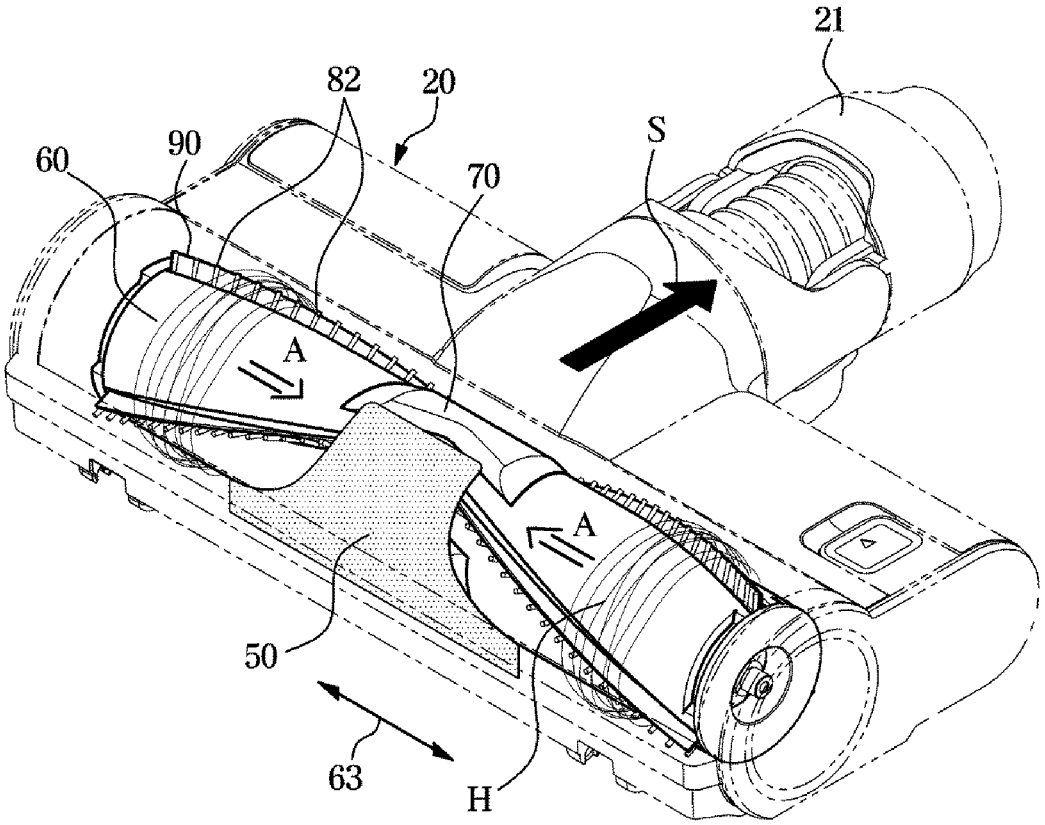
FIGS. 14 to 16 illustrate operations of the vacuum cleaner according to an embodiment of the disclosure.
Figure 15:
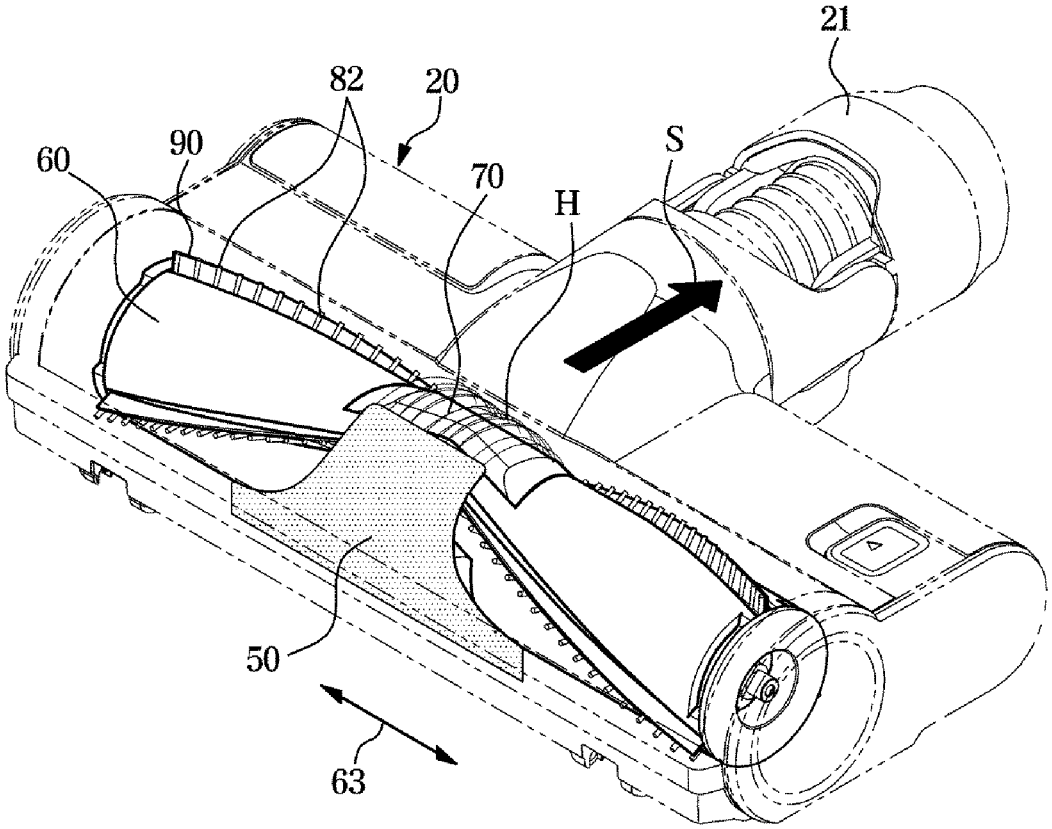
Figure 16:
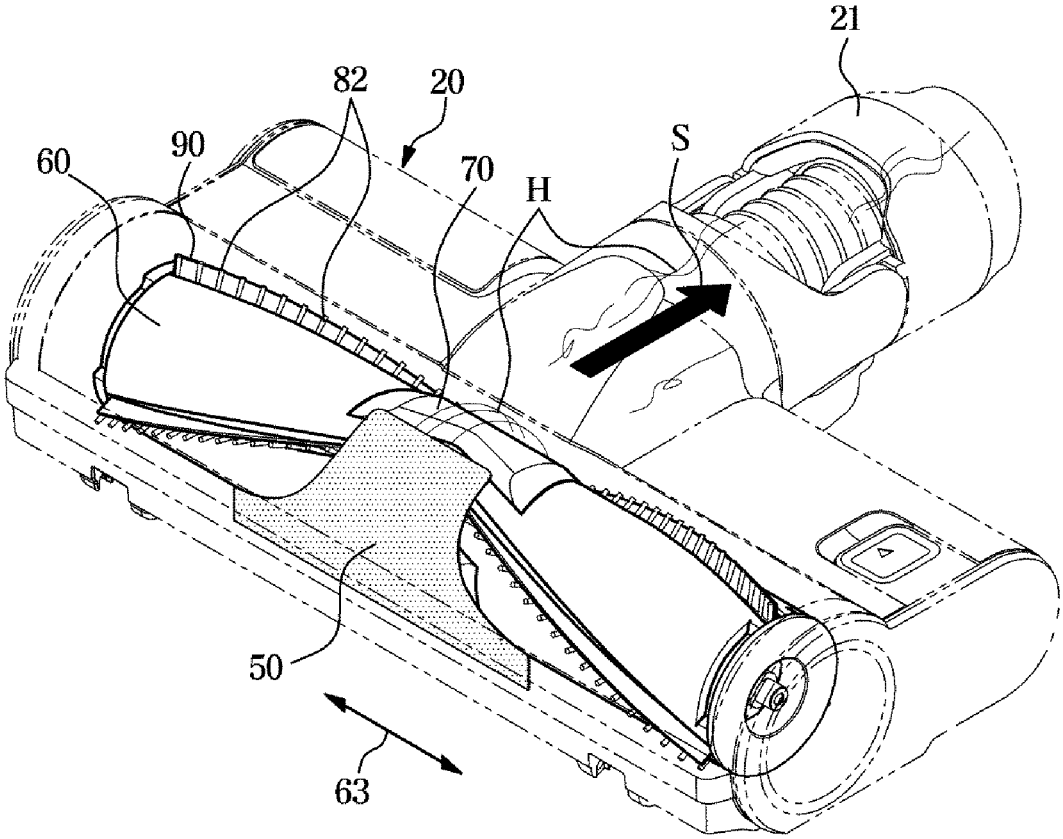

FIGS. 14 to 16 illustrate operations of the vacuum cleaner according to an embodiment of the disclosure.

Operations of the vacuum cleaner according to an embodiment of the disclosure will be described with reference to FIGS. 14 to 16.

As illustrated in FIG. 14, when the suction force generator 11 of the cleaner body 10 generates a suction force S and the drum brush 60 of the suction head 20 rotates, foreign substances are sucked into the suction head 20 through the suction port 37 of the suction head 20, and foreign substances H such as hair, animal fur, and thread may be wound on the drum brush 60. The foreign substances H wound on the drum brush 60 may be transferred in central portion directions A along the longitudinal direction 63 of the drum brush 60 by the suction force S.

As illustrated in FIG. 15, the foreign substances H transferred to the central portion in the longitudinal direction of the drum brush 60 come into contact with the foreign substance removal pad 50 provided on the inner surface 33 of the housing 30. The foreign substances H in contact with the foreign substance removal pad 50 are brought into friction with the foreign substance removal pad 50, and the anti-slip pad 70 provided on the drum brush 60 may prevent the foreign substances H from slipping on the drum brush 60 when the foreign substances H are brought into friction with the foreign substance removal pad 50.

As illustrated in FIG. 16, the foreign substances H are crushed or broken by friction between the foreign substances H and the foreign substance removal pad 50 to be unwound, so that the foreign substances H removed from the drum brush 60 may be sucked into the cleaner body 10 by the suction force S.

As is apparent from the above, according to the disclosure, foreign substances such as hair, animal fur, and thread can be crushed or broken by friction with a foreign substance removal pad. The crushed or broken foreign substances can be sucked smoothly into a cleaner body.

According to the disclosure, a brush having a plurality of brush bristles and a blade provided to prevent foreign substances from being caught between the plurality of brush bristles can be easily mounted on an outer circumferential surface of a drum body.

While the disclosure has been particularly described with reference to exemplary embodiments, it should be understood by those of skilled in the art that various changes in form and details may be made without departing from the spirit and scope of the disclosure.

Although the present disclosure has been described with various embodiments, various changes and modifications may be suggested to one skilled in the art. It is intended that the present disclosure encompass such changes and modifications as fall within the scope of the appended claims.

What is claimed is:

1. A vacuum cleaner comprising:

a cleaner body comprising:

a suction force generator configured to generate a suction force, and a foreign substance collection chamber configured to collect foreign substances; and a suction head connected to the cleaner body, configured to:

suck foreign substances on a surface to be cleaned, and guide the foreign substances to the foreign substance collection chamber, wherein the suction head comprises:

a housing including a suction port;

a drum brush rotatably installed in the housing such that the foreign substances are sucked into the housing through the suction port, the drum brush comprising a cylindrical drum body and a brush provided on an outer circumferential surface of the drum body;

a foreign substance removal pad provided on an inner surface of the housing, the foreign substance removal pad configured to remove foreign substances wound on the drum brush by friction; and an anti-slip pad provided on the outer circumferential surface of the drum body, the anti-slip pad configured to prevent the foreign substances from slipping on the drum body.

2. The vacuum cleaner according to claim 1, wherein the foreign substance removal pad is formed of a material having a higher friction coefficient than a friction coefficient of the housing.

3. The vacuum cleaner according to claim 2, wherein the foreign substance removal pad comprises sand paper comprising friction particulates.

4. The vacuum cleaner according to claim 1, wherein the foreign substance removal pad comprises a friction surface formed with irregularities to increase a friction force.

5. The vacuum cleaner according to claim 1, wherein:

the housing further comprises a lower housing and an upper housing, the suction port is formed in the lower housing, and the foreign substance removal pad is provided in the upper housing.

6. The vacuum cleaner according to claim 1, wherein the foreign substance removal pad is provided at a central portion in a longitudinal direction of the housing.

7. The vacuum cleaner according to claim 1, wherein the foreign substance removal pad and the brush are spaced apart from each other.

8. The vacuum cleaner according to claim 1, wherein the anti-slip pad is formed of a material having a higher friction coefficient than a friction coefficient of the drum body.

9. The vacuum cleaner according to claim 8, wherein the anti-slip pad is formed of a rubber material.

10. The vacuum cleaner according to claim 1, wherein the anti-slip pad comprises a friction surface formed with irregularities to increase a friction force.

11. The vacuum cleaner according to claim 1, wherein:

the anti-slip pad comprises inclined surfaces formed to be inclined with respect to the outer circumferential surface of the drum body, and each of the inclined surfaces are formed at opposite ends in a longitudinal direction of the anti-slip pad to allow the foreign substances to be transferred upward on the anti-slip pad.

12. The vacuum cleaner according to claim 1, wherein the brush comprises:

a brush band extending between opposite ends in an axial direction of the drum body; and a plurality of brush bristles protruding from the brush band, the plurality of brush bristles spaced apart from each other by a predetermined interval along the brush band.

13. The vacuum cleaner according to claim 12, wherein the drum brush further comprises a blade provided in a vicinity of the brush, the blade provided to extend along the brush band to prevent the foreign substances from being caught between the plurality of brush bristles.

14. The vacuum cleaner according to claim 13, wherein:

the drum body comprises a coupling groove formed on the outer circumferential surface of the drum body to extend between the opposite ends in the axial direction of the drum body, and the blade comprises a blade base inserted into and coupled to the coupling groove.

15. The vacuum cleaner according to claim 14, wherein the blade base comprises an installation groove extending between opposite ends in a longitudinal direction of the blade base to allow the brush band to be inserted and coupled thereto.

* * * * *